US005882052A

United States Patent [19]

Whitehead

[11] Patent Number: 5,882,052

[45] Date of Patent: Mar. 16, 1999

[54] SLIDING RAIL LATCH MECHANISM

[75] Inventor: David Frank Whitehead, Romford, England

[73] Assignee: Robert Malcolm Broadhead, Grants Pass, Oreg.

[21] Appl. No.: 805,496

[22] Filed: Feb. 26, 1997

Related U.S. Application Data

[63] Continuation of Ser. No. 416,884, filed as PCT/GB93/02191 Oct. 22, 1993 published as WO94/09234 Apr. 28, 1994, abandoned.

[30] Foreign Application Priority Data

Oct. 22, 1992 [GB] United Kingdom ..... 9222201
Jun. 11, 1993 [GB] United Kingdom ..... 9312122

[51] Int. Cl.[6] ..... E05B 47/00

[52] U.S. Cl. ..... 292/80; 292/251.5; 70/276; 70/58

[58] Field of Search ..... 292/19, 80, 81, 292/87, 251.5, DIG. 11, DIG. 12, DIG. 16; 206/308.1, 308.2, 309, 310–313, 387.11; 70/57, 57.1, 58, 63, 276

[56] References Cited

U.S. PATENT DOCUMENTS 4,917,244 4/1990 Sayers ..... 206/387
5,147,034 9/1992 Broadhead ..... 206/1.5
5,209,086 5/1993 Bruhwiler ..... 70/57.1
5,289,914 3/1994 Holmgren ..... 206/1.5
5,366,162 11/1994 Holmgren ..... 206/387
5,468,031 11/1995 Holmgren ..... 292/81
5,588,315 12/1996 Holmgren ..... 70/57.1

*Primary Examiner*—Steven N. Meyers
*Assistant Examiner*—Gary Estremsky
*Attorney, Agent, or Firm*—Charles D. Gunter, Jr.

[57] ABSTRACT

The present invention provides a detent mechanism adapted to be mounted on a container which is to contain one or more articles, notably CD cases, which container has an access aperture through which the article(s) can be inserted into or moved from the container. The detent mechanism is adapted to retain the article within the container and is formed from a mounting member adapted to be carried externally in the container, preferably at or adjacent the access aperture of the container. A latch member is adapted to be carried externally of the container by the mounting member and is movable between a retracted position at which at least the distal end of which is adapted to retain an article within the container. The latch member is also movable to a extended position in which latch member permits removal of the article through the access aperture by being located out of the line of travel of the article as the article is withdrawn from the container. A locking member, such as a spring loaded pin, is movable from an operative position at which it retains the latch member in its retracted position and an inoperative position in which it permits extension of the latch member.

16 Claims, 8 Drawing Sheets

SLIDING RAIL LATCH MECHANISM

This application is a continuation of application Ser. No. 08/416,884, filed as PCT/GB93/02191 Oct. 22, 1993, published as WO94/09234 Apr. 28, 1994, now abandoned.

The present invention relates to a locking mechanism, notably to a latch mechanism for a display container.

BACKGROUND TO THE INVENTION

Compact discs, audio and video tapes are usually put up for sale in a plastic case or the like, which carries information about the disc or tape as well as carrying sales promotional material or artwork to attract a purchaser. The case is often displayed at the point of sale in an open access rack or other display so that a would-be purchaser can browse through the display and select the discs or tapes he wishes to purchase. However, in order to reduce the risk of theft from such an open access display, the actual disc or tape is not held within the displayed case, but is stored separately. Therefore, when the disc or tape is purchased, the sales person has to identify the disc or tape from the empty case, to locate the disc or tape in the store and to marry the disc or tape up with the empty case. This is time consuming and may also require that the sales person leaves the sales counter un-manned whilst locating the disc or tape in the store.

In order to reduce these problems, it has been proposed to fit the case into a display container fitted with a lock mechanism which secures the case for the disc or tape within the container so that a thief cannot readily gain access to the disc or tape without breaking the container or removing the container from the shop. The container can be fitted with alarm means so that it cannot be removed from the display or shop without actuating an audible or visual alarm. Typically, the container is locked by means of a spring loaded pin which engages a recess or the like in a wall of the case. The pin is retracted by applying a strong magnet to the pin mounting, for example at the sales counter, so as to release the case from the container. However, such mechanisms are either bulky and obtrusive, or can be accessed externally so that the security of the container is compromised. Furthermore, the pin must register with a recess in the wall of the case and this limits the range of cases which can be used within a given container, notably where the design of the case is altered by the manufacturer. The pin must also be retracted when the case is loaded into the display container, which again is time consuming.

In my PCT Application No GB 92/00633, I have described and claimed a novel form of security container which reduces the above problems and which is adapted to contain one or more articles, which container has access means whereby the article(s) can be inserted into or removed from the container, the container being provided with a detent mechanism adapted to retain the article within the container, which detent mechanism comprises:

a. a sole plate member located adjacent the interior of one wall of the container and adapted to move axially substantially parallel to the plane of that wall and to bear against a face of the article which is to be inserted into or removed from the container through said access means;

b. a biassed member adapted to move between an operative position at which the member engages the sole plate member so as to retain it against axial movement, and an inoperative position at which the biassed member permits axial movement of the sole plate member; and c. a stop member, preferably carried by said sole plate member, adapted to engage said article and to retain said article within the container when said biassed member engages the sole plate member in its operative position.

Preferably there is a second stop member carried by the sole plate member which is adapted to engage said article as it is inserted into the container, whereby the sole plate member is moved axially by said article as it is inserted into the container so that the first stop member prevents removal of the article from the container when the sole plate is carried by the article to the position at which the sole plate member is engaged by the biassed member.

I have now devised a simplified form of the detent mechanism which can be made in a modular form so as to fit a number of different forms of existing container without the need to modify those containers. The simplified form of detent mechanism can be applied to the container during manufacture thereof, or can be applied as a retro-fit component with little or no modification to existing containers.

SUMMARY OF THE INVENTION

Accordingly, the present invention provides a detent mechanism adapted to be mounted on a container which is to contain one or more articles, which container has an access aperture through which the article(s) can be inserted into or removed from the container, the detent mechanism being adapted to retain the article within the container, which detent mechanism comprises:

a. a mounting member adapted to be carried externally of the container and, preferably, adjacent the access aperture of the container;

b. a latch member adapted to be carried externally of the container by the mounting member and adapted to move between a retracted position at which at least the distal end thereof is adapted retain an article within the container, preferably by engaging the article, and an extended position at which the latch member permits removal of the article through the access aperture by being located out of the line of travel of an article as the article is withdrawn from the container; and c. a locking member adapted to move from an operative position at which it retains the latch member in its retracted position and an inoperative position at which it permits extension of the latch member.

The invention also provides a container which is to contain one or more articles, which container has an access aperture through which the article(s) can be inserted into or removed from the container, provided with a detent mechanism of the invention mounted externally upon a wall of the container and adjacent to the access aperture of the container whereby the latch member is adapted to retain the article within the container when in its retracted position and to permit removal of the article through the access aperture when the latch member is in its extended position.

The invention can be applied to retaining a wide range of types of article within a wide range of shapes and sizes of container. However, the invention is of especial application in retaining a single generally rectangularly shaped article within a correspondingly shaped chamber within a container into which the article is a sliding fit through an open end face of the container. Thus, the invention is of use in retaining a book or similar article within a clear walled container so that the book is protected within the container and yet cannot be removed until the latch member is moved to its extended or inoperative position. For convenience, the invention will be described hereinafter in terms of a compact disc (CD) in its case to be retained within a clear plastic walled display container.

Preferably, the mounting member is provided in the form of a base plate or housing which is adapted to be located externally upon the container, for example by being welded, snap fitted or otherwise secured to the container. The base plate or housing is adapted to receive one or more of the other components of the detent mechanism and to secure them to the wall of the container adjacent the access aperture. The latch member is journalled for axial movement upon the base plate or within the housing. For example, the housing can carry internal guide ribs or projections which support the latch member laterally and guide the axial movement of the latch member. Preferably, the ribs or projections are formed so as to allow the distal end of the latch member to drop away from the container as the latch member is extended axially so that the distal end of the latch member is carried out of the line travel of an article as it is withdrawn from the container through the access aperture.

Accordingly, from one preferred aspect, the present invention provides a detent mechanism adapted to be mounted on a container which is to contain one or more articles, which container has an access aperture through which the article(s) can be inserted into or removed from the container, the detent mechanism being adapted to retain the article within the container, which detent mechanism comprises:

a. a plate member adapted to be located externally upon the container and adjacent the access aperture to the container so as to form part of, or to be mounted parallel to, a wall of the container;

b. a housing member carried by said plate member externally of the container;

c. a latch member carried by said housing and adapted to move axially externally of and substantially parallel to the plane of the said wall of the container between axially retracted and extended positions, said latch member having a recess intermediate the ends thereof and at at least the distal end thereof a stop member adapted to engage an article located within the container when the latch member is in its axially retracted position within the housing, the latch member being configured so that when the latch member is in its axially extended position the stop member is carried clear of the line of travel of the article as the article is withdrawn from the container; and d. a biassed locking member adapted to move from an operative position at which it engages the said recess so as to retain the latch member in its axially retracted position and an inoperative position at which it permits axial extension of the latch member.

Alternatively, the base plate or the base of the housing can carry one or more upstanding lugs which engage co-operating slots or recesses in the under side of the latch member so that the latch member is slidably mounted by the inter-engagement of the lugs and slots or recesses. The engagement at the distal end of the latch member can be such that it disengages as the latch member is extended so as to allow the latch member to pivot and thus carry the distal end of the latch member clear of the withdrawal path of an article through the access aperture.

From another aspect, the present invention provides a detent mechanism which serves to retain an article within a container as described above, the detent mechanism comprising:

a. a latch member mounted on the exterior surface of one of the walls of the container in the vicinity of the access aperture, said latch member being capable of adopting a position to inhibit the removable of the article through the access aperture or a position to permit the removal of the article through the access aperture;

b. guide means for guiding the latch member for sliding and pivotable movement in relation to the said exterior wall of the container to move from one position to the other; and c. a spring loaded locking member which is moveable between a locking position whereby movement of the latch member is restrained and a release position whereby movement of the latch member is permitted. Preferably, the guide means also provide the mounting means by which the latch member is mounted on the container.

It is within the scope of the present invention to form the mounting member or the lugs or other mountings for the latch member integrally with the wall of the container. For convenience, the invention will be described hereinafter in terms of a demountable detent mechanism rather than one which has part thereof formed integrally with the container.

Preferably, the latch member comprises an axially extending arm slidably journalled upon the mounting member or within the housing. The arm preferably carries or is formed with a transverse stop member at its distal end which extends into the path of travel of an article through the access aperture when the arm is in its retracted position and either bears against the article in the container or provides a stop which prevents withdrawal of the article. Where the latch member is slidably mounted upon upstanding lugs or the like, the arm preferably takes the form of an inverted channel member carrying the slots or recesses which are to engage the lugs in the inner base wall of the channel. When the lugs are engaged with the slots or recesses, the arm is secured to the base plate or the wall of the container by a bayonet type of mounting and the walls of the channel surround the mounting and prevent tampering with the mounting.

The movement of the arm from its retracted position to its extended position to release the article from the container is prevented by means of the locking member. Preferably, the locking member is a spring loaded stud which engages an appropriate recess, one of the stud or recess being carried by the latch member and the other by the mounting member. Thus, for example, the arm has a transverse recess into which a spring loaded stud carried by the mounting member or the housing locates when the arm is in the axially retracted position. Alternatively, the arm can carry the spring loaded stud and the mounting member or housing can have the recess into which the stud locates. Preferably, the pin is magnetic so that it can be withdrawn against the spring bias to release the arm for axial movement.

Preferably, the proximal end of the latch member is provided with a second stop member which engages the locking member or a co-operating stop carried by the mounting member so as to prevent excessive withdrawal of the latch member.

The detent mechanism can be mounted at any appropriate position on the container walls so that the stop carried by the latch member can obstruct the line of travel of an article as it is removed from the container. Typically, the detent mechanism will be mounted adjacent the base or top corner of the container and adjacent the access aperture. However, where the latch member is elongated, it may be possible to mount the detent mechanism at other locations on the container wall.

The detent mechanism of the invention can readily be made by extruding the component parts from a suitable plastic and securing them together by adhesive, sonic welding or any other suitable technique. In the case where the latch member is mounted upon the container or base plate by inter-engagement of lugs and slots or recesses as described above, such engagement can be a snap fit to prevent accidental separation of the latch member from the container or base plate and such a construction avoids the need for adhesive or welding, notably where the upstanding lugs are formed integrally with the wall of the container.

As indicated above, the detent mechanism can be made so that it forms an integral part during the manufacture of a security case for a CD disc, an audio or video tape or other article. However, the invention readily lends itself to the production of a standard detent mechanism which can then be adhered or otherwise secured to the base, side wall or top face of a standard display case to convert that case into a security case, thus avoiding the need to fabricate a specific security mechanism to fit a given case or to incorporate a security mechanism during the manufacture of the case.

DESCRIPTION OF THE DRAWINGS

A preferred form of the detent mechanism of the invention will now be described by way of illustration only with respect to the accompanying drawings in which.

DESCRIPTION OF THE PREFERRED EMBODIMENT

The container typically comprises a generally rectangular box having clear plastic or similar side walls 1 and an open end face 2 giving a closed ended rectangular chamber within the container. The side walls 1 can be solid or partially open so that the contents of the container can be inspected externally. The side walls can also carry magnetic or other labels which actuate an alarm system if the container is removed from the display or shop. The container is, apart from the detent mechanism, of conventional design and construction.

Figure 1:
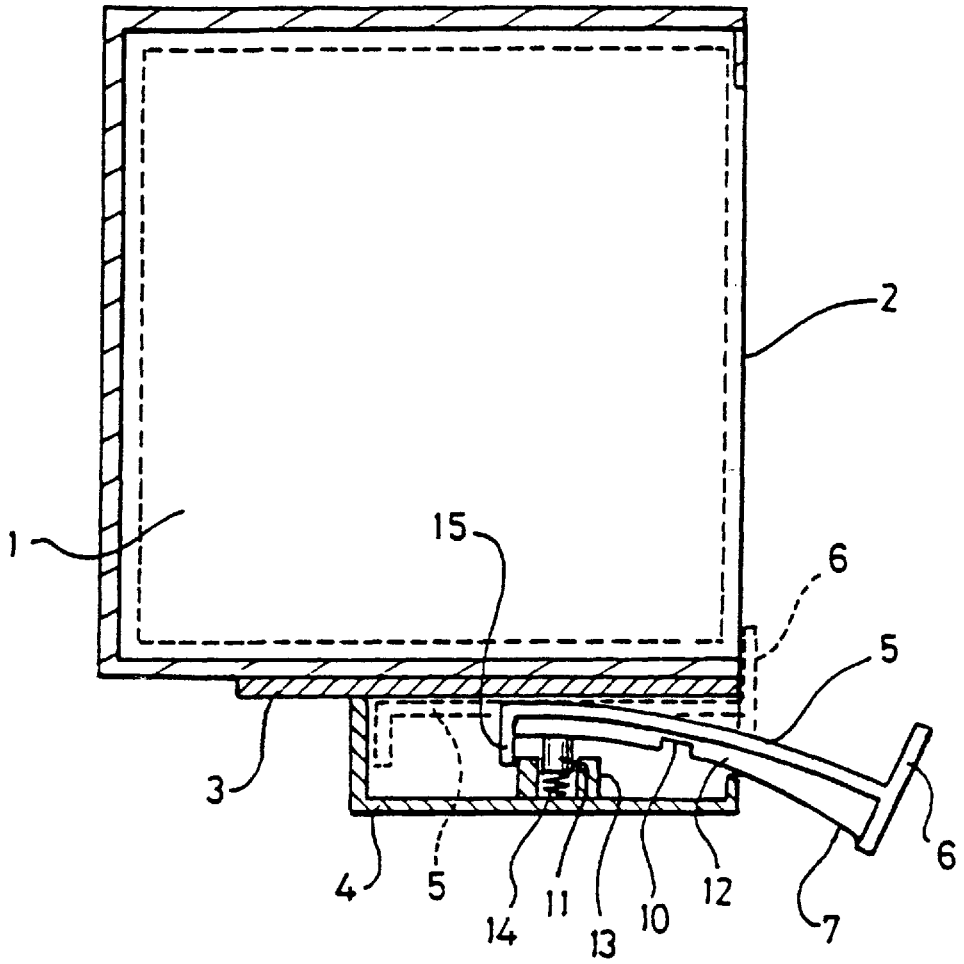
FIG. 1 is a diagrammatic side section of a security display container for a CD case incorporating one form of the detent mechanism of the invention.
Figure 2:
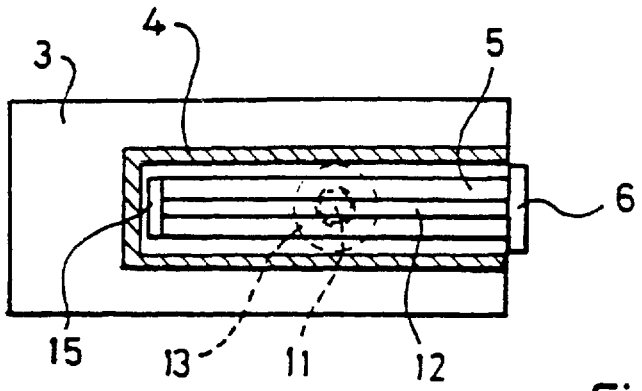
FIG. 2 is a plan sectional view from below of the detent mechanism of FIG. 1.

The container is dimensioned so that a case for a CD, shown dotted in FIGS. 1 and 2, is a sliding fit within the container. If desired, the container can be provided with a snap or clip on extension (not shown) so that the overall dimensions of the container thus formed can be axially enlarged to conform to the dimensions of the display rack.

Figure 9:
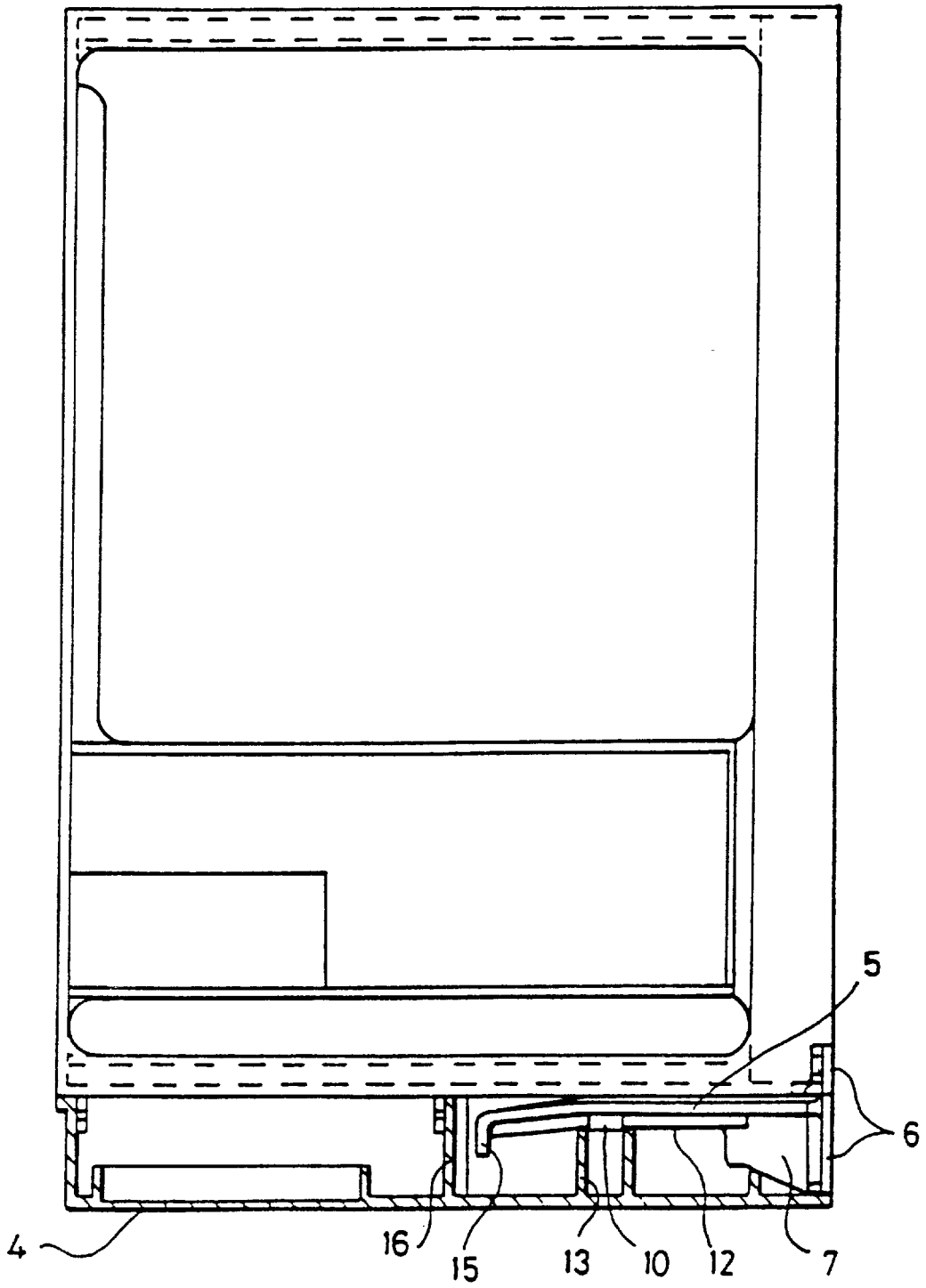
FIG. 9 shows an alternative form of the detent mechanism of FIG. 1 in the axially retracted position.
Figure 10:
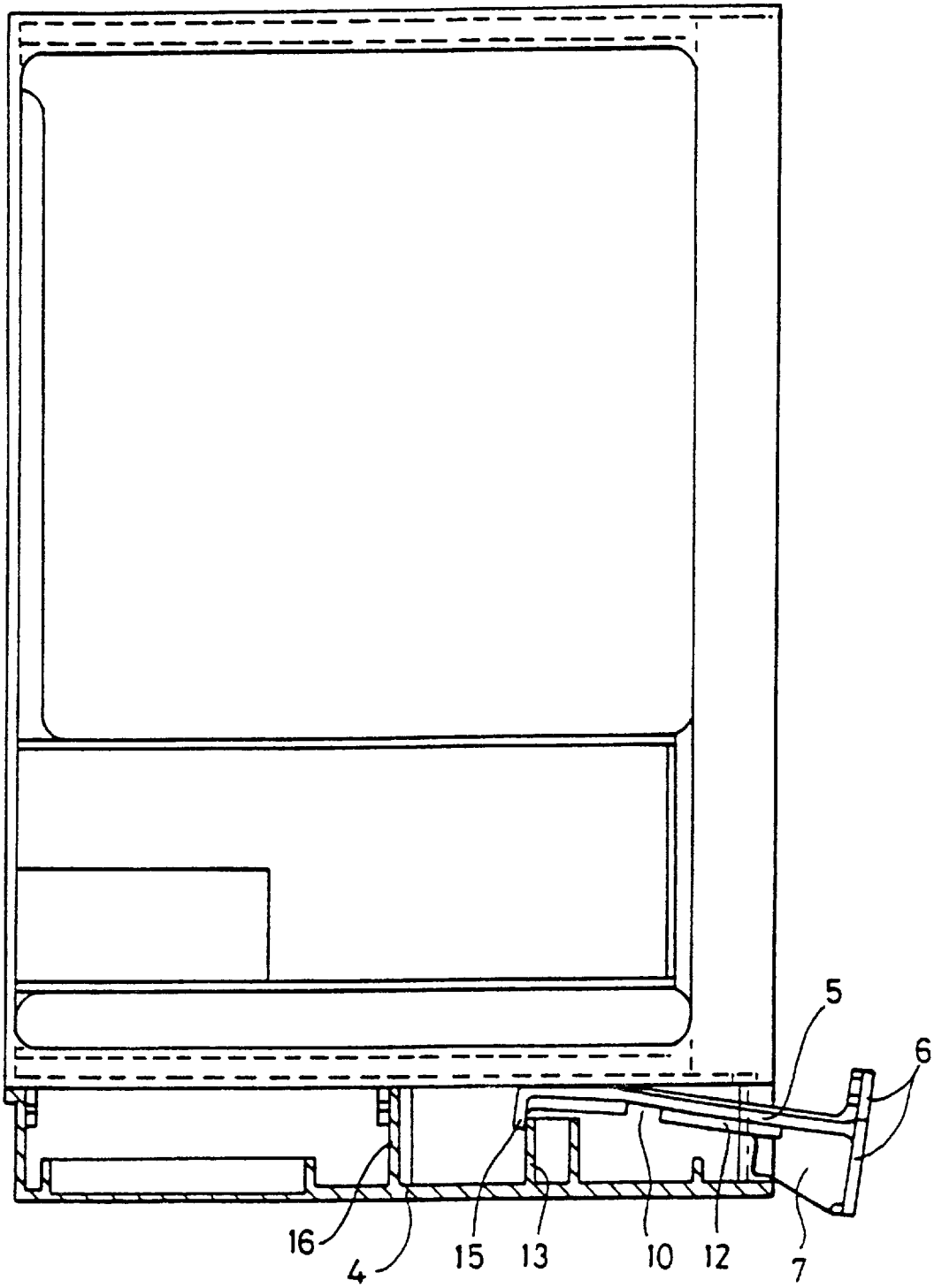
FIG. 10 shows an alternative form of the detent mechanism of FIG. 1 in the axially extended position.

The basal wall of the container adjacent the open front face is provided with a mounting plate 3 for the detent mechanism which is welded or otherwise secured to the container. As shown in FIG. 1, the mounting plate 3 and the detent mechanism can be provided as a separate retrofitted component which is welded or otherwise secured to the outer face of the basal wall of an existing container so that it lies parallel to but externally of the basal wall of the container. Alternatively, the detent mechanism can be incorporated into the container during the manufacture of the container. As shown in FIG. 1, the detent mechanism can extend for only part of the length of the wall on which it is mounted. However, as shown in FIGS. 9 and 10, it may be desired to provide greater areas of adhesive or welding contact between the detent mechanism and the container wall and to form the detent mechanism of the same length as the container wall. In this case, the base plate 3 may be omitted and the detent mechanism provided with a housing 4 which is welded along its basal periphery to the container as shown in FIGS. 9 and 10.

Figure 11:
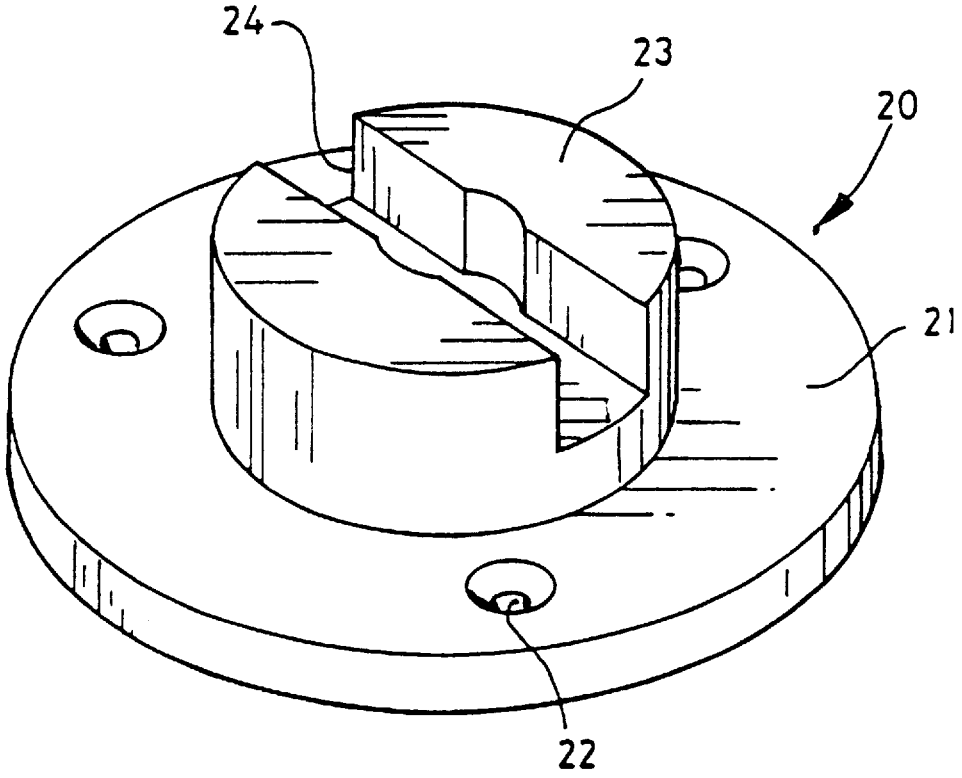
FIG. 11 shows a magnetic device for releasing the locking member in the detent mechanism.

As shown in FIG. 1, the base plate 3 carries an external housing 4 which is dimensioned so that it slides within the transverse groove 24 of a magnetic release actuator device 20 as shown in FIG. 11 as used to withdraw the locking pins in present designs of container. Typically, such an actuator device comprises a base plate 21 having screw holes 22 by which it is secured to a worksurface (not shown). The base plate carries a circular magnet 23 having a transverse diametric groove 24 cut in it. When the housing 4 is inserted into the groove 24, the magnet 23 pulls the locking pin within the housing axially and releases the latch member in the detent mechanism. It is also preferred that the housing 4 corresponds in width to the width of the CD case or other article the container houses so that the housing can be mounted in existing article display systems.

The housing 4 is typically of a generally rectangular shape and has one open end face located adjacent the open end face of the container. Within the housing 4 is slidably journalled an arm which can move axially within the housing 4 from an axially extended position shown in FIG. 1 to an axially retracted position shown in FIG. 2. The distal end of arm 5 is provided with an upstanding stop member 6 which provides a transverse stop member which obstructs the removal of the CD case from the container when the arm 5 is in the axially retracted position as shown dotted in FIG. 1.

Preferably, arm 5 is formed with a bow so that as it is extended the distal end will droop as shown dotted in FIG. 1 to drop the stop member 6 out of the withdrawal path of the CD case. If desired, the side walls of the housing 4 can carry inwardly projecting ribs or the like which serve to locate and guide the movement of arm 5; or slots can be formed in the side walls into which transverse lugs carried by the arm 5 engage. However, as shown in FIG. 1, it is preferred to provide the under lip of the distal end of arm 5 with a tapering ramp member 7 which rides over the bottom lip of the open end of the housing to cause the arm 5 to rise as the arm is retracted into the housing. The ramp 7 can also be connected to the stop member 6 to impart rigidity thereto as shown in FIG. 1.

The arm 5 forms a sliding carrier for the stop member 6, to carry the stop member 6 in and out of the path of withdrawal of the CD from the container 1. The underside of arm 5 carried a recess 10 into which a pin 11 locates so as to prevent axial movement of the arm when in the axially retracted position. The recess 10 is conveniently formed as a cut out in an axial rib 12 on the underside of arm 5, the rib 12 imparting rigidity to the arm 5. The pin 11 is located within a sleeve 13 upstanding from the outer wall of the housing 4 and is biassed upwardly by a spring 14 located within the sleeve 13, pin 11 is retained in the sleeve by the arm 5 which in turn is a sliding fit against the underside of the inner face of the housing, which is preferably provided by the base plate 3. Arm 5 preferably carries a stop 15 at its proximal end, i.e. that end deepest into the housing, which butts against the upstand of sleeve 13 to prevent the arm 5 from being withdrawn excessively from the housing. It will be appreciated that the pin 11 and the spring 14 can be carried by the arm 5 and the pin can engage in a recess in the base wall of the container, the base plate 3 or the outer wall of the housing 4.

In use, the housing 4 is located in the slot 24 of the magnetic release device 20 which retracts pin 11 into the sleeve 13 and allows arm 5 to be axially extended to allow stop 6 to drop out of the line of travel of a CD case through the open and of the container. The CD case is inserted into the container and arm 5 is then axially retracted, for example by pressing the exposed end face of stop 6, until pin 11 engages the recess 10 on the underside of arm 5. Stop 6 engages the exposed front bottom corner of the CD case and prevents it from being withdrawn from the container until pin 11 is retracted by the magnetic release device 20 to allow arm 5 to be extended again.

As stated above, the detent mechanism comprising the sole plate 3, the housing 4, the arm 5 and stops 6 and 15, the sleeve 13 and pin 11 and spring 14 can all be formed as a separate assembly which is secured to the base of an existing container; or the detent mechanism can be incorporated into a container during manufacture of the container, in which case the sole plate 3 can form part or all of the container basal wall. Furthermore, as shown in FIGS. 9 and 10, the housing 4 can extend for the full length of the container wall, in which case the housing can incorporate one or more internal walls 16 to impart rigidity to the construction.

Figure 3:
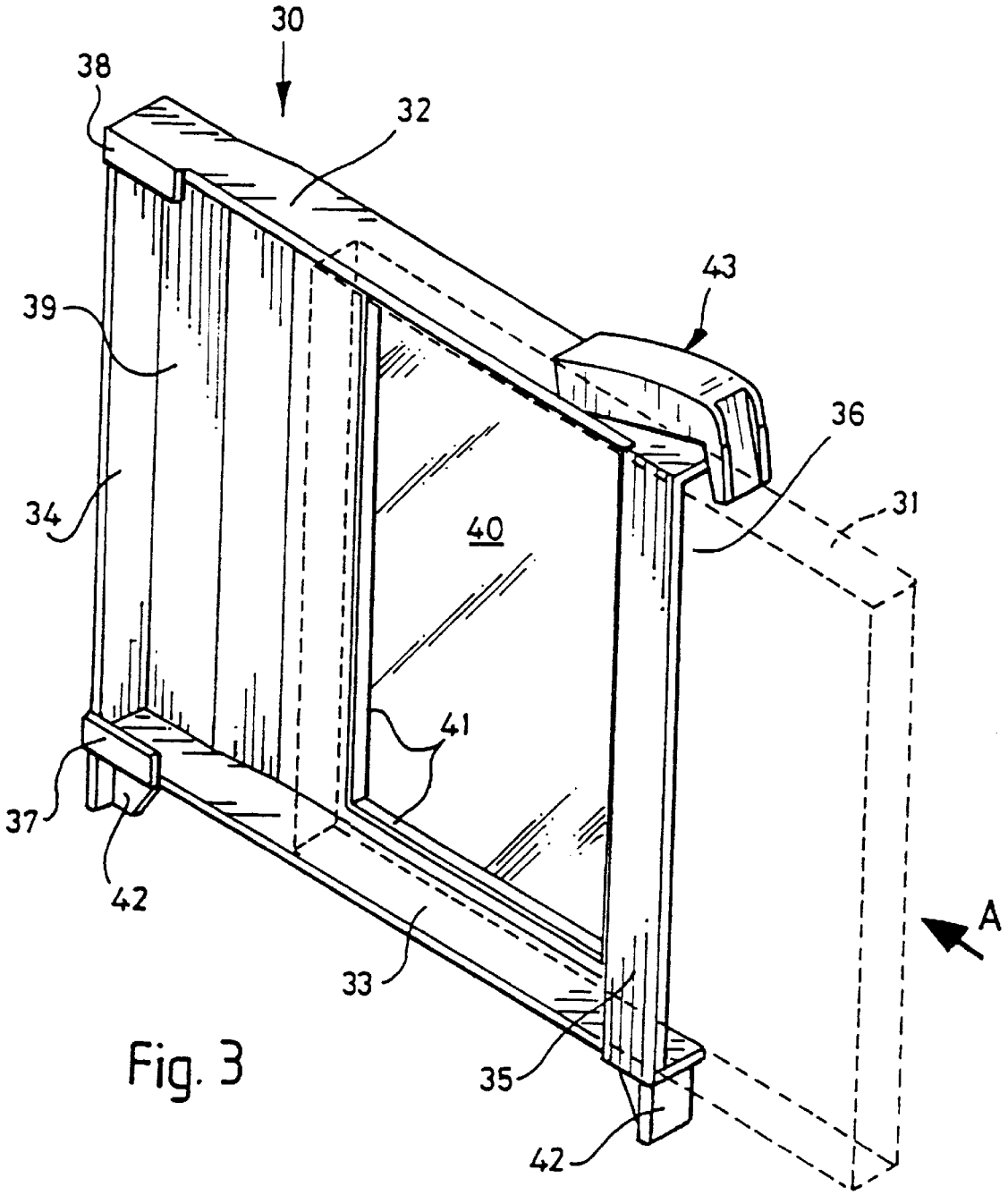
FIG. 3 is a perspective view of a CD security case carrying another form of the detent mechanism of the invention with the detent mechanism in the axially extended position.
Figure 4:
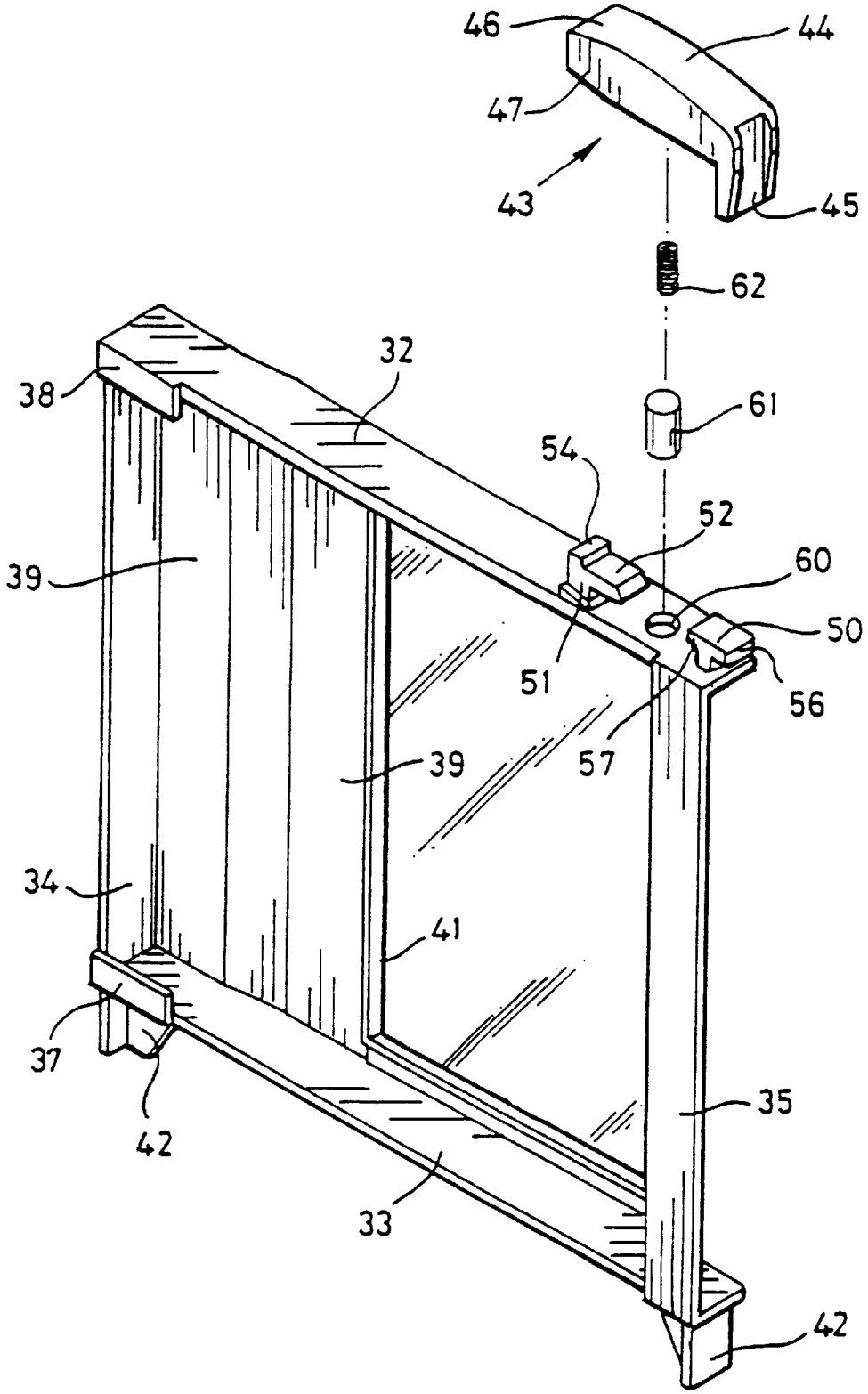
FIG. 4 is an exploded view of the detent mechanism of FIG. 3.
Figure 8:
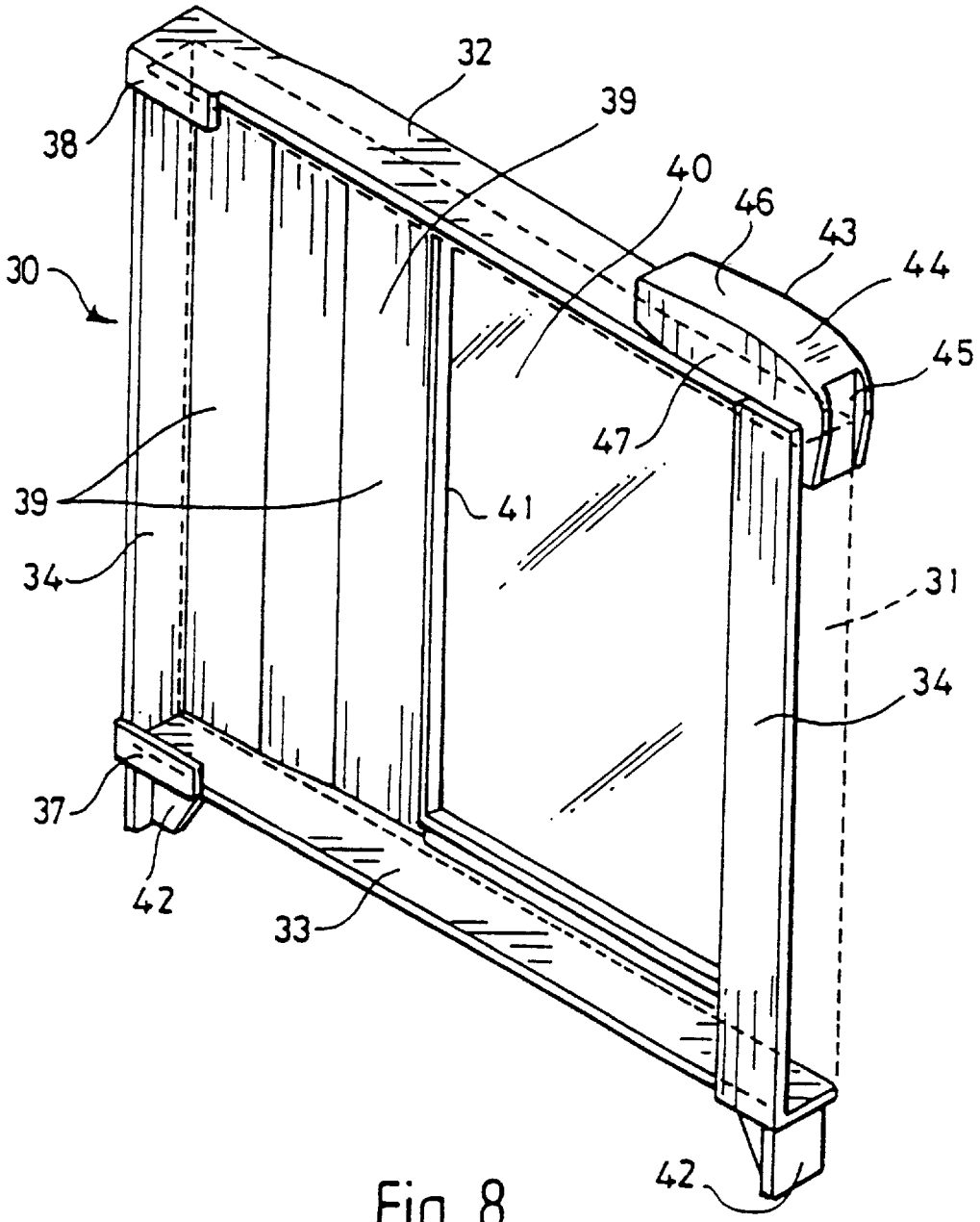
FIG. 8 shows the device of FIG. 3 with the latch member in the axially retracted position.

As shown in FIGS. 3, 4 and 8, a container 30 for storing a CD case 31, represented in dotted outline, is generally in the form of an open-sided rectangular box with continuous upper and lower walls 32, 33 and rear wall 34. A side strip 35 extends between walls 32, 33 adjacent an opening 36 at the front of the container 30 through which the CD case 31 can be inserted (arrow A, FIG. 3) or from which the CD case 31 can be withdrawn. At the same side, but spaced from the strip 35 so as to lie adjacent the rear wall 34, there are a pair of upper and lower flanges 37, 38. At the opposite side, the container 30 has further strips 39 extending between the upper and lower walls 32, 33 but adjacent the rear wall 34 and further walls defining a window 40 lined with a narrow edge strip 41. The side structures 35, 37, 38, 39, 40 serve to guide the CD case 31 laterally when it is being slid in or out of the container 30. Base feet 42 are provided beneath the lower wall 33 to permit the container 30 to be disposed in an upstanding display position. Adjacent the opening 36 there is a locking mechanism generally designated 43 which serves selectively to release and lock the article 11 within the container 10.

FIG. 3 shows the locking mechanism 43 in the open or released state when the CD case 31 can be freely introduced into the container in the direction of arrow A or withdrawn in the opposite direction. In contrast, FIG. 8 shows the locking mechanism 43 in the retention state where the CD case 31 is prevented from being withdrawn from the container 30.

The locking mechanism 43 is shown in more detail in FIGS. 4 to 7. The mechanism 43 comprises an L-shaped latching arm 44 with the minor arm of the L forming a dependent stop 45. The major arm of the L may have a partial U-shaped cross-section at least at the rear with a top wall 46 and side walls 47 which merge into the minor arm 45. As can be appreciated from FIGS. 3, 4 and 8, the minor arm 45 hooks and fits over an upper corner region of the CD case 31 when the CD case is locked into the container 30.

The L shaped latching arm 44 is mounted upon the container 30 by means of a pair of blocks 50, 51 which are mounted on top of the upper wall 32 of the container 30. These blocks can be secured to wall 32 by adhesive, welding or any other suitable means. Alternatively, the blocks 50 and 51 can be moulded integrally with the wall 32 during manufacture of the container As shown in FIGS. 3 to 8, the rear block 51 has a forwardly projecting tongue 52 which slidably engages in recesses or slots 53 in the side walls 47 at the rear of the major arm of the L shaped latching arm 44. The tongue 52 adjoins an projection 54 at the rear of block 51 and the recesses 53 have enlarged angled and stepped portions 55 at their rear.

The front guide block 50 has a somewhat T-shaped side profile with tongues 56, 57 projecting forwardly and rearwardly respectively. The rearwardly projecting tongue 57 of the block 50 is somewhat narrower than the forwardly projecting tongue 56. A rectangular recess 58 in the forward portion of arm 44 is shaped to fit onto the tongues 56, 57 and a narrow slot 59 extends forwardly from recess 58 and is shaped to receive the forwardly projecting tongue 56 when the arm 44 is moved rearwardly with respect to wall 32. A blind bore 60 in the upper wall 32 of the container 30 is disposed between the blocks 50, 51 and receives a pin 61. A compression spring 62 is held in a complementary blind bore 63 in the arm 44 and acts to urge the pin 61 downwardly into the bore 60.

The arm 44 can be snap fitted onto the blocks 50, 51 with the spring 62 and the pin 61 trapped therebeneath during assembly. When fitted, the arm 44 can adopt one of three working positions depicted in FIGS. 5 to 7. In the locked or retaining position depicted in FIG. 7 the tongue 52 is fully engaged in the slots 53 and the rear wall 54 engages in the recessed portions 55 in the rear of arm 44 and lies flush or substantially flush with the rear face of the arm 44. The forward tongue 56 of the block 50 is likewise engaged in the slot 59. This prevents the arm 44 from being lifted clear from the upper wall 32 and the stop 45 provided by the short arm of the L prevents the CD case within the container 30 from being withdrawn. The pin 61 is engaged in the aligned bores 60, 63 and thus prevents axial movement of the arm 44.

To unlock the arm 44 and permit the release of the CD case 31, the container is inverted and the arm 44 placed into the groove 24 of the device 20 of FIG. 11. Pin 61 is attracted by the magnetic field fully into the bore 63 to compress the springe 62 and draw the pin out of the bore 60 in the wall 32 of the container 30. The arm 44 can now be moved axially forwardly with respect to the blocks 50 and 51 to adopt the forward position shown in FIG. 5 where the tongue 56 is released from the slot 59. The forward motion of the arm 44 can be accomplished by moving the CD case 31 forwardly to push on the stop 45 carried by arm 44. When the arm 44 has been moved forwardly, the plunger 61 is now supported on the wall 32 and the container 30 can be removed from the device 20. To release the CD case 31 from the container 30, the arm 44 is pivoted about the tongue 52 on the rear block 51 so that the stop 45 is lifted clear of the CD case 31 as shown in FIG. 6.

Figure 5:
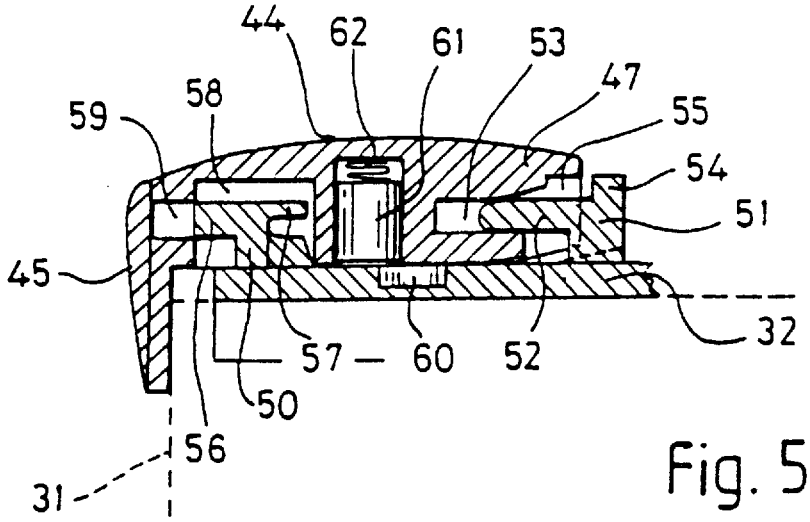
FIG. 5 is a vertical section through the detent machanism of FIG. 3 showing a partially engaged position of the lugs and slots of the mounting of the latched member.
Figure 6:
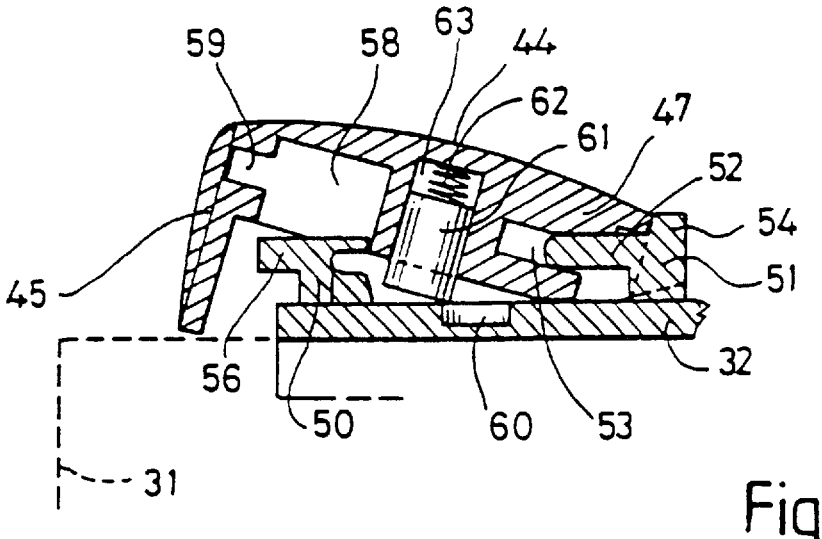
FIG. 6 is a vertical section through the detent mechanism of of FIG. 3 showing a partially engaged position of the lugs and slots of the mounting of the latched member.
Figure 7:
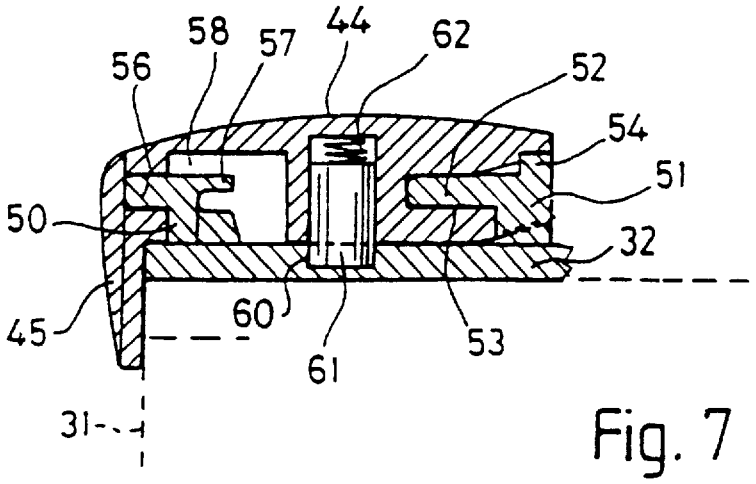
FIG. 7 is a vertical section through the detent mechanism of FIG. 3 showing a fully engaged position of the lugs and slots of the mounting of the latched member.

To insert a fresh CD case 31 into the container 30, the sequence is simply reversed so that from the open position of FIG. 6 the CD case 31 is inserted through the open face 36 of the container 30 and the arm 44 is swung down to engage on the top corner region of the CD case 31 as shown in FIG. 5. The CD case 31 and the arm 44 are then pushed rearwardly to relocate the arm 44 in the position shown in FIG. 7 when the pin 61 will re-engage in bore 60 in wall 32 to lock the arm in position.

The components of the container 30 including the locking mechanism 43, except for the pin 61 and the spring 62, can all be fabricated from injection moulded plastics material which may be transparent or translucent. It is also envisaged that, as known per se, the interior of the container 30 would be provided with a magnetic strip or the like which activates an alarm system if the CD case 31 is removed along with the container without proper authorization.

I claim:

1. A container for housing one or more articles, the container comprising:

a container body having an interior that is to contain the at least one articles, the container body having an access aperture through which the articles can be inserted into or removed from the interior of the container body;

at least one mounting member carried upon an external wall of the container body adjacent the access aperture thereof;

a unitary latch member carried externally of the container body by the mounting member wherein the mounting member and latch member include means for allowing axial and transverse movement of the latch member with respect to the container body between a retracted position at which at least a distal end of the latch member is adapted to retain an article within the container body and an extended position at which the latch member permits removal of the article through the access aperture;

a linearly moveable releasable locking member comprising a pin formed from a material which causes the locking member to move transversely with respect to the latch member under the influence of a magnetic field wherein the container, mounting member, and latch member include means for allowing the locking member to move from an operative position at which it retains the latch member in the retracted position and an inoperative position at which the locking member permits axial movement of the latch member; and biassing means for urging the locking member to move transversely with respect to the latch member into engagement with the aperture or recess when the locking member is brought into register with the aperture or recess as the latch member is moved axially with respect to the mounting member into its retracted position.

2. A container as claimed in claim 1, characterised in that the latch member engages in sliding engagement with guide members carried by the mounting member so as to guide the travel of the latch member between its retracted and extended positions.

3. A container as claimed in claim 2, characterised in that the mounting member comprises guide member and serves to locate the latch member upon the wall of the container and to guide the movement of the latch member.

4. A container as claimed in claim 2, characterised in that the guide members have lugs which engage in recesses.

5. A container as claimed in claim 4, characterised in that engagement of the guide members and the latch member permits both axial movement and pivoting of the latch member with respect to the container.

6. A container as claimed in claim 1, characterised in that the mounting member is formed integrally with the container wall.

7. A container as claimed in claim 1, characterised in that the mounting member comprises a plate member carried by the wall of the container and a housing member carried by the plate member to form a hollow housing within which the latch member is at least in part journalled for axial and transverse movement with respect to the container.

8. The container of claim 1, wherein:

the latch member has a channel formed therein; and the mounting member is received within the channel of the latch member.

9. The container of claim 1, wherein:

the mounting member comprises two axially spaced apart mounting members, one mounting member engaging the distal end of the latch member, the other engaging a proximal end of the latch member.

10. The container of claim 1, wherein:

latch member and mounting member have inter-engaging lugs and grooves that are orientated so that axial movement of the latch member with respect to the mounting member at least partially disengages the lugs and grooves to permit the latch member to pivot with respect to the mounting member.

11. The container of claim 10, wherein:

the mounting member comprises two mounting members, one located adjacent the distal end of the moveable member and the other located adjacent a proximal end of the latch member to provide distal end and proximal end mountings between the latch member and the mounting members respectively; and the inter-engaging lugs and grooves at the distal end mounting are axially shorter than those at the proximal end mounting so that upon axial movement of the latch member the lugs and grooves at the distal end mounting disengage, while those at the proximal end mounting remain engaged so that the distal end of the latch member is allowed to move transversely with respect to the distal mounting member.

12. A detent mechanism for a container having an interior which is to contain at least one articles, which container has an access aperture through which the articles can be inserted into or removed from the interior of the container, the detent mechanism comprising:

at least one mounting member adapted to be carried upon an external wall of the container adjacent the access aperture therof;

a unitary member adapted to be carried externally of the container by the mounting member wherein the mounting member and latch member include means for allowing axial and transverse movement of the latch member with respect to the mounting member between a retracted position at which at least the distal end of the latch member is adapted to retain an article within the container and an extended position at which the lattch member permits removal of the article through the access aperture;

a linearly slidable reeasable locking member formed from a material which causes the locking member to move transversely with respect to the latch member under the influence of a magnetic field wherein the mounting member and latch member include means for allowing the locking member to move from an operative position where the locking member engages the latch member to ratain the locking member in the retracted position and an inoperative position where the locking member is disengaged from the latch member to permit axial movement of the latch member; and biasing means for urging the locking member to move transversely with respect to the latch member into the engaged position.

13. A detent mechanism as claimed in claim 12, characterised in that the mounting member comprises a plate member adapted to carry a housing member within which the latch member is journalled, which plate member is adapted to be located externally upon a wall of the container adjacent the access aperture to the container so as to be mounted parallel to, the wall of the container.

14. A container having an interior which is to contain at least one article, the container having an access aperture through which the article can be inserted and removed from the interior of the container, the container having a detent mechanism mounted externally upon an external wall of the container adjacent the access aperture of the container, the detent mechanism comprising:

a moveable member mounted externally upon the container wall adjacent the access aperture to the container, the moveable member having proximal and distal ends and carrying a stop member at the distal end thereof;

two axially spaced apart mounting members carried externally by the container wall adjacent the access aperture thereof, one mounting member being adjacent the distal end of the moveable member and the other adjacent the proximal end of the moveable member, the moveable member being moveable both axially and transversely with respect to the mounting members and the container wall upon which the moveable member is mounted so that the moveable member is moved between an operative position where the stop member obstructs the passage of an article through the access aperture of the container, and an inoperative position where the stop member is moved transversely out of the path of an article being passed through the access aperture; and wherein the mounting members and the moveable member have axially orientated inter-engaging lugs and grooves to provide distal end and proximal end mountings, respectively, wherein the moveable member is retained upon the mounting member and is guided to move axially with respect to the mounting members and the container wall upon which the mounting member is carried, the inter-engaging lugs and grooves of the distal end mounting being shorter than those of the proximal end mounting so that upon axial movement of the moveable member, the lugs and grooves of the distal end mounting disengage axially while those at the proximal end mounting remain engaged to allow the distal end of the moveable member to be moved transversely with respect to the distal mounting member;

a linearly acting releasable locking pin member that moves transversely with respect to the axial movement of the moveable member under the influence of a magnetic field between an engaged position in which locking pin member retains the moveable member in its operative position, and a disengaged position in which the locking pin member permits axial movement of the moveable member with respect to the mounting members, the locking pin member being carried by the moveable member and being received within a recess in the wall of one of the container and the mounting member when in the engaged position; and a coil spring that acts upon the locking pin member for urging the locking pin transversely with respect to the moveable member to the engaged position, the recess and locking pin member registering with one another when the moveable member is moved axially with respect to the mounting member into the operative position.

15. The container of claim 14, wherein:

the mounting members are integrally formed with the container wall.

16. A detent mechanism for use in a container having an interior for containing an article, the container having an access aperture through which the article can be inserted into and removed from the interior of the container, the detent mechanism being mounted externally upon an external wall of the container adjacent the access aperture of the container, the detent mechanism comprising:

a plate member that mounts to the external wall of the container, the plate member having two mounting members in axially spaced apart positions;

a moveable member having a distal end and a proximal end and that mounts externally upon the container wall adjacent the access aperture to the container by means of the two axially spaced apart mounting members, the moveable member having a stop member at the distal end and being movable axially and transversely with respect to the mounting members so that the stop member can be moved between an operative position where the stop member obstructs the passage of an article through the access aperture of the container, and an inoperative position where the stop member is moved transversely out of the path of the article being passed through the access aperture; and wherein the mounting members and the moveable member have axially orientated inter-engaging lugs and grooves to provide distal end and proximal end mountings, respectively, so that the moveable member is retained upon the mounting members and is guided to move axially with respect to the mounting members, the inter-engaging lugs and grooves at the distal end mounting being axially shorter than those at the proximal end mounting so that upon axial movement of the moveable member the lugs and grooves at the distal end mounting disengage axially while those at the proximal end mounting remain engaged so that the distal end of the moveable member may be moved transversely with respect to the distal mounting member;

a linearly acting releasable locking member that is movable transversely with respect to the axial movement of the moveable member under the influence of a magnetic field from an engaged position where the locking member retains the moveable member in its operative position, and a disengaged position where the locking member permits axial movement of the moveable member with respect to the mounting members, the locking member including a pin member carried by the moveable member and engaging a recess in at least one of the plate and mounting members; and a coil spring that acts upon the locking member for urging the locking pin transversely with respect to the moveable member into engagement with the recess when the locking pin and the recess are brought into register with one another as the moveable member is moved axially with respect to the mounting members into the operative position.

* * * * *